US006130596A

United States Patent [19]

Yu

[11] Patent Number: 6,130,596

[45] Date of Patent: Oct. 10, 2000

[54] AUTO TRIPPING MULTI-STATE KEY SWITCH

[76] Inventor: Tsung-Mou Yu, No. 4, Alley 2, Lane 23, Sec. 3, Pa-Te Raod, Pan-Chiao City, Taipei, Taiwan

[21] Appl. No.: 09/368,763

[22] Filed: Aug. 5, 1999

[30] Foreign Application Priority Data

Feb. 25, 1999 [CN] China ..... 88202945

[51] Int. Cl.[7] ..... H01H 27/00; H01H 27/06; H01H 19/58

[52] U.S. Cl. ..... 337/50; 337/85; 337/333; 337/334; 337/362; 337/351; 200/43.11; 200/21; 200/179; 200/273

[58] Field of Search ..... 337/334, 36, 37, 337/50, 85, 86, 112, 113, 333, 337, 362, 351, 379, 380; 200/43.01–43.22, 179, 21, 24, 237, 273, 303, 564, DIG. 39

[56] References Cited

U.S. PATENT DOCUMENTS

| | | | |
|---|---|---|---|
| 3,630,306 | 12/1971 | Shur et al. | 180/114 |
| 3,650,131 | 3/1972 | Eichenauer | 70/252 |
| 3,660,624 | 5/1972 | Bell | 200/44 |
| 3,819,887 | 6/1974 | Lipschutz | 200/44 |
| 3,826,116 | 7/1974 | Messera et al. | 70/388 |
| 3,912,886 | 10/1975 | Allen et al. | 200/11 A |
| 4,099,395 | 7/1978 | Garza | 70/360 |
| 4,198,552 | 4/1980 | Tahara | 200/44 |
| 4,227,056 | 10/1980 | Johnston et al. | 200/44 |
| 4,400,954 | 8/1983 | Nakamoto et al. | 70/186 |
| 4,419,546 | 12/1983 | Arthur | 200/11 G |
| 4,558,193 | 12/1985 | Test | 200/43.05 |
| 4,623,763 | 11/1986 | Krause | 200/11 K |
| 4,639,562 | 1/1987 | Fredrickson | 200/43.08 |
| 4,748,297 | 5/1988 | Sorenson et al. | 200/11 J |
| 4,803,314 | 2/1989 | Sorenson et al. | 200/11 J |
| 5,235,832 | 8/1993 | Lux et al. | 70/368 |
| 5,252,791 | 10/1993 | Williams | 200/11 C |
| 5,669,489 | 9/1997 | Von Ende | 200/570 |
| 6,040,535 | 3/2000 | Thalhammer | 200/43.08 |

FOREIGN PATENT DOCUMENTS

| | | | |
|---|---|---|---|
| 3204020 | 8/1983 | Germany | H01H 27/00 |
| 8-175330 | 7/1996 | Japan | B60R 25/04 |

*Primary Examiner*—Leo P. Picard
*Assistant Examiner*—Anatoly Vortman
*Attorney, Agent, or Firm*—Senniger, Powers, Leavitt & Roedel

[57] ABSTRACT

This invention is related to an auto tripping multi-state key switch, comprising a switch housing being formed with at least one guide groove and one slideway at an inner side thereof; a first contact strip and a second contact strip both fastened to the switch housing, the first contact strip including a first contact and the second contact strip including a second contact; a bi-metallic strip having thereon a third contact and being connected to a connection plate include thereon a fourth contact; a key being provided with at least one first protrusion thereon for engaging the guide groove within the switch housing, the key having an end that is formed with a serrated edge; a rotary housing being provided with at least one second protrusion thereon for engaging the guide groove and the slideway allowing sliding movement of the rotary housing within the switch housing, the rotary housing having a top end being formed with a serrated edge that cooperates with the serrated edge at the bottom of the key, and the rotary housing having a bottom; and a first resilient member including an end that is fastened to the switch housing and another end that is in contact with the bottom of the rotary housing to bias the rotary housing towards the key in relation of the switch housing. This invention can automatically trip the switch to form a closed circuit while encountering current overload so as to ensure electrical safety.

9 Claims, 10 Drawing Sheets

AUTO TRIPPING MULTI-STATE KEY SWITCH

FIELD OF THE INVENTION

This invention is related to an auto tripping multi-state key switch, in particular to a key switch that can be automatically tripped to form a closed circuit while encountering current overload so as to ensure electrical safety.

BACKGROUND OF INVENTION

FIG. 1 illustrates an exploded view of a conventional key switch 1, comprising an upper housing 10, a lower housing 11, a hollow cylindrical housing 12 that substantially extends upwards from a center of the upper housing 10, the cylindrical housing 12 being formed at an inner face thereof with four linear guide grooves 13 that are spaced from each other in 90 degrees apart, the guiding grooves 13 being formed with a beveled step face 14 therebetween, the step faces 14 each having a top of a relatively greater thickness and projecting towards an inner side of the hollow cylindrical housing 12. The switch 1 further comprises a cylindrical key 15 being formed at a bottom thereof with four pentagonal protrusions 16 engaging and moving along the linear guide grooves 13, the pentagonal protrusions 16 each having a tip 22 facing downwards and a bottom edge 17 located between the protrusions 16 and extending upwards along the tips 22 to form inverse-V configurations such that the entire bottom edge 17 of the key 15 forms a serrated periphery. The key 15 may engage an engaging unit 18 therein; the engaging unit 18 is formed with a square aperture 19 therein and includes four triangular protrusions 20 at the bottom thereof. The triangular protrusions 20 form an outer diameter that is in-between the inner diameters formed by opposing ends of the step faces 14 in the hollow cylindrical housing 12. The triangular protrusions 20 each has a beveled face 21 that adapts to the tips 22 of the pentagonal protrusions 16 located at the bottom of the key 15.

The engaging unit 18 is further provided therebeneath with a follower rotary body 23 having a square column 24 at an upper portion that adapts to be inserted into the square aperture 19 of the engaging unit 18 such that the follower rotary body 23 may be driven to rotate by the engaging unit 18. The follower rotary body 23 has a bottom being formed by a disc 25, above that a spring 26 is provided engaging around the square column 24. The spring 26 has an upper end that engages a lower edge of the engaging unit 18. The disc 25 is provided with two opposing raised faces 27 at the outer bottom edge of the disc 25, the raised faces 27 each having a thickness that gradually increases while approaching towards a periphery of the disc 25. The disc 25 is further provided with two separate semi-circular supports 28 at the center thereof. The semi-circular supports 28 each have an arcuate inner edge and are provided with a Z-like metallic strip 29 therebetween, as shown in FIG. 1. The lower housing 11 of the conventional switch 1 is formed with a circular recess 2 for receiving the disc 25 located at the bottom of the follower rotary body 23. The recess 2 is formed with an emboss 3 at the center thereof for engaging the two semi-circular supports 28 located at the bottom of the disc 25. The lower housing 11 is further provided with two metallic conductive contacts 4 each having an end 5 that forms a leaf extending towards the circular recess 2 and elevating slightly upwards. The two conductive contacts 4 are each provided with a screw 6 thereon for connecting electrical leads (not shown.) FIGS. 2A to 2C are cross-sectional views of the conventional key switch 1 illustrating the internal structure of the key switch 1 and the switch transition from open to closed circuits. FIG. 2A illustrates the switch 1 in its state of closed circuit. Under the state of closed circuit, the ends 5 of the two contacts 4 are in contact with the raised faces 27 located at the bottom of the disc 25. The follower rotary body 23 made of insulative material subjects the switch 1 to be in the state of closed circuit. A user may push the key 15 to switch the switch I from the state of closed circuit to the state of open circuit. At this time, the pentagonal protrusions 15 located at the bottom of the key 15 still overlay the triangular protrusions 20 located at the bottom of the engaging unit 18 as that shown in FIG. 2A, and engage the linear guide grooves 13 such that both the key 15 and engaging unit 18 are movable along a perpendicular direction. When the engaging unit 18 moves downward to outside of the step faces 14 of the triangular protrusions 20 located at the bottom of the engaging unit 18, the engaging unit 18 is no longer retrained by the linear grooves 13 because the outer diameter of the triangular protrusions 20 located at the bottom of the engaging unit 18 is smaller than the inner diameter of the hollow cylindrical housing 12 beneath the step faces 14, and the engaging unit 18 is thus now rotatable. Because the spring 26 will exert an upward force on the engaging unit 18 after being compressed by the engaging unit 18, the spring 26 will subject the triangular protrusions 20 located at the bottom of the engaging unit 18 to follow the pentagonal protrusions 16 and serrated edges 17 for upward and rotary motions. While viewing from top, the engaging unit 18 rotates a minute angle in a counterclockwise direction subjecting the triangular protrusions 20 to engage the inverse-V serrated edges 17 of the key 15, such as that shown in FIG. 2B, and driving the follower rotary body 23 to rotate simultaneously.

When the user releases the key 15, the thrust of the spring 26 subjects upward movement of the engaging unit 18 such that the triangular protrusions 20 of the engaging unit 18 urge against the lower edges of the beveled step faces 14 and the engaging unit 18 continues to trace along the lower edges of the beveled step faces 14 in upward and counterclockwise rotary motions. The engaging unit 18 further drives simultaneous rotation of the follower rotary body 23 until the triangular protrusions 18 of the engaging unit 18 re-enter the linear grooves 13. At this time, the pentagonal protrusions 16 located at the bottom of the key 15 again overlay the triangular protrusions 20 located at the bottom of the engaging unit 18; the key 15 and the engaging 18 are further pushed upwards by the spring 26 until the pentagonal protrusions 16 of the key 15 urge against a lip 7 of the hollow cylindrical housing 12, as shown in FIG. 2C. At this time, the follower rotary body 23 is exactly 90 degrees away from the upper and lower housings 10, 11 of the switch 1, and opposing sides of the Z-like metallic strip 29 on the bottom of the disc 25 are in contact with the two ends 5 of the conductive contacts 4, respectively, such that the two contacts 4 are electrically connected by means of the ends 5 and the Z-like metallic strip 29 to enable open circuit of the switch 1.

The user may push and release the key 15 again such that the engaging unit 18 and the follower rotary body 23 may rotate for 90 degrees in a similar manner to cause the ends 5 of the two conductive contacts 4 to be in contact with the raised faces 27 located at the bottom of the disc 25, so as to switch the switch I from the state of open circuit to the state of closed circuit, such as that shown in FIG. 2A.

However, such a conventional construction is of a passive switch type, which relies on pushing motions of the user to switch between the open circuit and the closed circuit and thus fails to provide auto switch features. Therefore, when the switch encounters current overload under the state of open circuit, it is liable to cause electrical sparks and result in safety hazards.

SUMMARY OF THE INVENTION

It is a primary object of this invention to overcome defects of conventional art and to provide an auto tripping multi-state key switch, the switch comprising a switch housing being formed with at least one guide groove and one slideway at an inner side thereof; a first contact strip and a second contact strip that are fastened to the switch housing, the first contact strip being provided with a first contact and the second strip being provided with a second contact; a deformable bi-metallic strip having thereon a third contact, the bi-metallic strip being connected to a connection plate provided with a fourth contact; a key that is provided with a first protrusion engaging the guide groove within the switch housing such that the key is only slidable along the guide groove, wherein the key features an inner serrated edge; a rotary housing that is provided with at least a second protrusion engaging the guide groove and the slideway such that the rotary housing is slidable in the switch housing, the rotary housing having a bottom, and a top end being formed with a serrated edge matching the serrated edge of the key so as to allow rotation of the rotary housing when the key is being pushed; and a first resilient member having an end that is fastened to the switch housing and another end being in contact with the bottom of the rotary housing to bias the rotary housing towards the key in relation of the switch housing; wherein the bi-metallic strip resiliently urges towards the first contact causing the third contact to be in contact with the first contact while the connection plate continues to resiliently urge on the bottom of the rotary housing.

When the key switch of this invention is at a first position, that is, where the second protrusion is restrained by the slideway such that the rotary housing is maintained in a static state, the fourth contact on the connection plate is detached from the second contact subjecting the key switch to be under the state of closed circuit. To switch the key switch from a state of closed circuit to a state of open circuit, a user may push the key causing the key switch to be at a second position due to cooperation between the key and the rotary housing, that is, where the second protrusion moves away from the guide groove and where the bottom of the rotary housing exerts a force on the connection plate such that the fourth contact is in contact with the second contact of the second contact strip subjecting the key switch to be under the state of open circuit.

The bi-metallic strip as used in this invention is made by joining two or more than two metallic sheets having different coefficients of thermal expansion. When current flowing through such a bi-metallic strip exceeds a pre-determined value that causes thermal bending of the bi-metallic strip, such a current overload will trip the key switch.

One of the primary features of this invention resides in that, when the key switch encounters current overload at the second position of open circuit, deformation of the bi-metallic strip of the key switch of this invention, as a result of temperature increase, subjects the third contact of the bi-metallic strip to move away from the first contact thereby auto-tripping the key switch into the state of closed circuit. Therefore, current overload will automatically trip the key switch of this invention.

Another feature of this invention resides in that, this invention may further comprise an insulative body having an end that is connected to the second resilient member fastened within the switch housing, such that another end of the insulative body resiliently biases towards a contact interface between the first contact and the third contact. Hence, when the third contact is detached from the third contact subjecting the key switch under the state of closed circuit, the insulative body interposes between the first contact and the third contact due to resilience of the second resilient member. Therefore, this invention can automatically trip the switch to form a closed circuit while encountering current overload so as to ensure that the key switch is maintained under the state of closed circuit prior to resetting the key switch.

The structure and characteristics of this invention can be realized by referring to the appended drawings and explanations of the preferred embodiments.

EXPLANATIONS OF PREFERRED EMBODIMENTS

Figure 1:
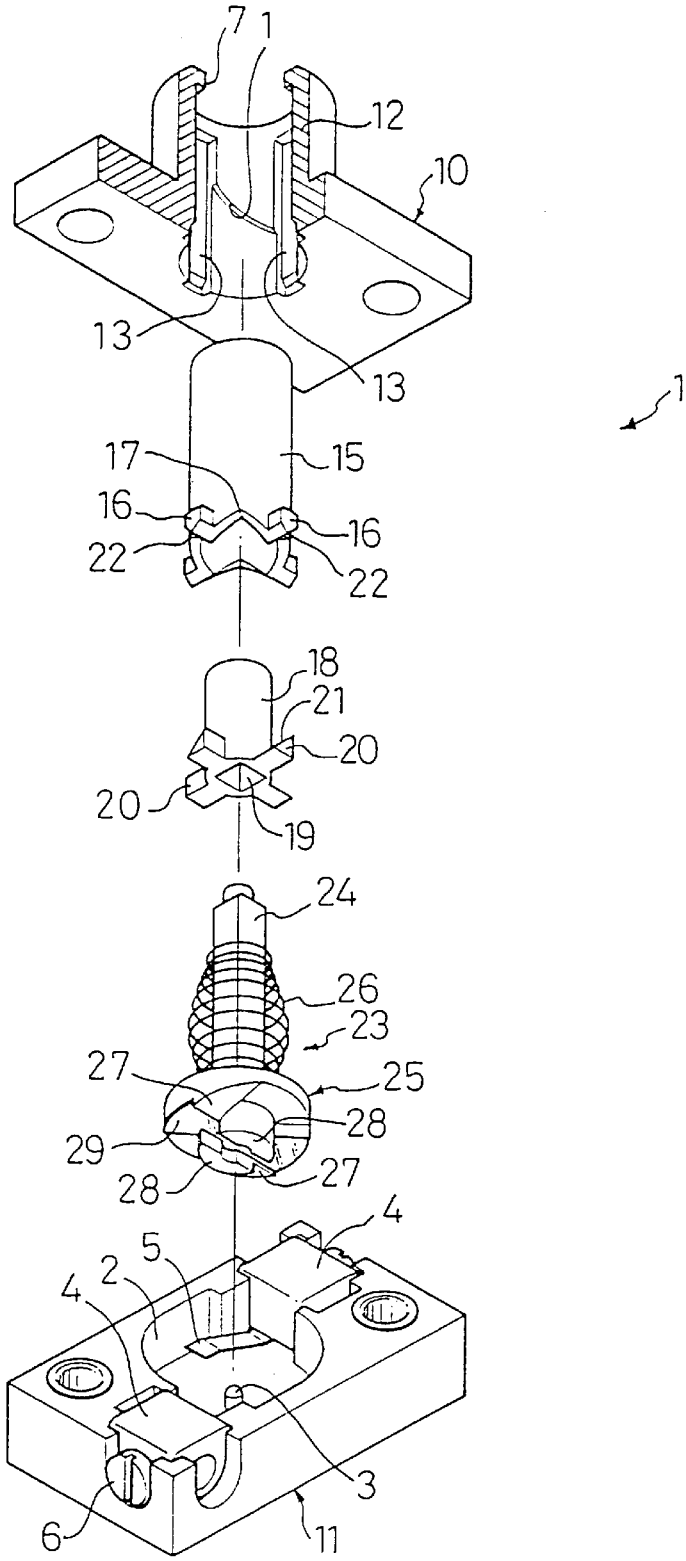
FIG.1 (PRIOR ART)
FIG. 1 is an exploded view of a conventional key switch.
Figure 2A:
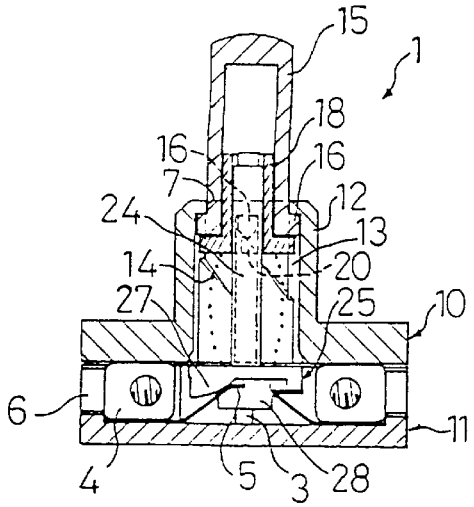
FIG.2A (PRIOR ART)
FIGS. 2A–2C are cross-sectional views of the conventional key switch illustrating the states of open and closed circuits.
Figure 2B:
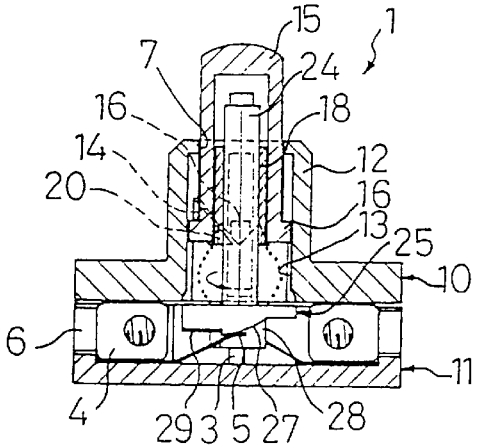
FIG.2B (PRIOR ART)
Figure 2C:
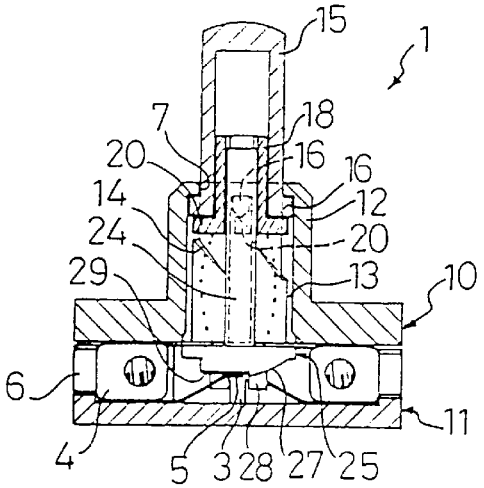
FIG.2C (PRIOR ART)

This invention is related to an auto tripping multi-state key switch. Detailed constructions of a preferred embodiment are illustrated in an exploded view of FIG. 3. This invention comprises a switch housing 30 that may be separated into two parts. The housing 30 is formed at an inner side thereof with a cylindrical surface 31 having at least one guide groove. In this embodiment, the housing 30 is alternatively formed with three relatively deep, linear guide grooves 32 and three relatively shallow, linear guide grooves 33. The guide grooves 32 and 33 each has an open end. The cylindrical surface 31 is further formed with a slideway 34 between the three deep guide grooves 32.

Figure 3:
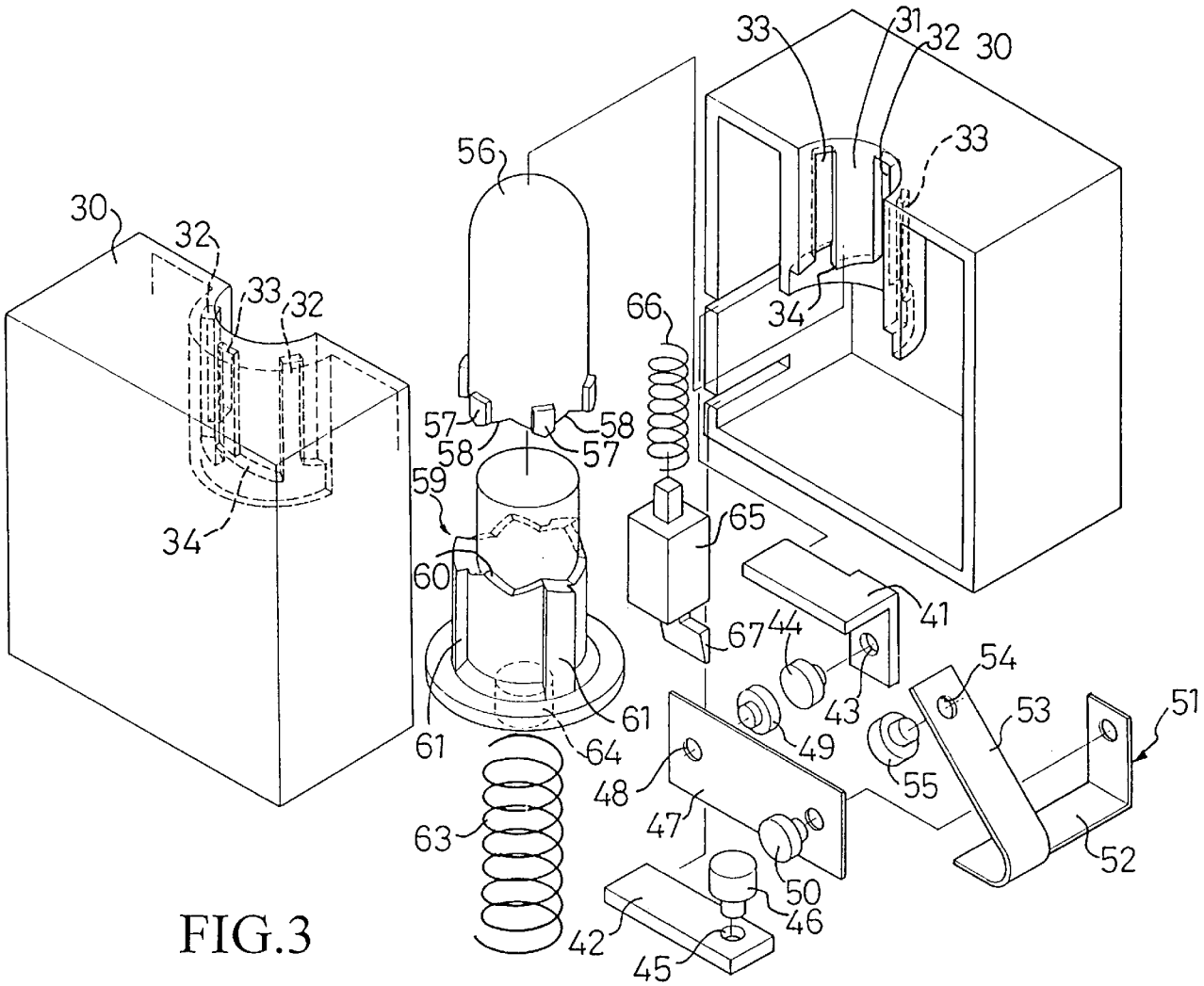
FIG. 3 is an exploded view of this invention.

As shown in FIG. 3, this invention further comprises a first contact strip 41 and a second contact strip 42 both fastened to the switch housing 30. The two contact strips 41, 42 each have an end that exposes out of the switch housing 30 so as to be connected to electrical leads (not shown). The first contact strip 41 includes a first contact aperture 43 for connecting to a first contact 44. The second contact strip 42 is formed with a second contact aperture 45 for connecting to a second contact 46. This invention further comprises a bi-metallic strip 47 having thereon a third aperture for connecting to a third contact 48, that is at a location that allows contact with the first contact 44. The bi-metallic strip 47 of this invention, after stamping processes, is able to resiliently urge towards the first contact 44. The bi-metallic strip 47 is further connected to a connection plate 51 by means of a rivet 50. The connection plate 47 includes a level, rectangular portion 52, and a resiliently compressible portion 53 that substantially raises upwards. The resiliently compressible portion 53 has an end that is formed with a fourth contact aperture 54 for connecting to a fourth contact 55, that is at a location that allows contact with the second contact 46 such that when the resiliently compressible portion 53 of the connection plate 51 is depressed and deformed, the fourth contact 55 may be in contact with the second contact 46.

This invention further comprises a key 56 that is provided with plural first protrusions 57 thereon for engaging the guide grooves 32 and 33 within the switch housing 30. In this embodiment, the key 56 is provided with six first protrusions 57, corresponding to the total number of the guide grooves 32 and 33 subjecting the key 56 to be only slidable in a linear direction along the guide grooves 32 and 33. The key 56 has an end that is formed with a serrated edge 58. The key 56 is further provided with a rotary housing 59 therebeneath. The rotary housing 59 has a top end that is in contact with the key 56 and formed with a serrated edge 60, that cooperates with the serrated edge 58 at the bottom of the key 56 and has equivalent number of teeth. The rotary housing 59 is provided with at least a second protrusion 61 thereon. In this embodiment, the rotary housing 59 is provided with three rib-shaped second protrusions 61, corresponding to the total number of deep linear guide grooves 32 and to the serrated slideway 34 so as to allow sliding movement and rotation of the rotary housing 59 within the cylindrical surface 31 of the switch housing 30 when the key 56 is being pushed.

This invention further comprises a first resilient member, such as a helical spring 63 in this embodiment. The helical spring 63 includes a bottom end that is fastened to the switch housing 30 and a top end that is in contact with the bottom 62 of the rotary housing 59 to bias the rotary housing 59 towards the key 56 in relation of the switch housing 30. The bottom 62 of the rotary housing 59 may be provided with a post 64 for guiding the helical spring 63.

This invention may further comprise an insulative body 65 having an end that is connected to the second resilient member, such as a helical spring 66 of this embodiment, fastened within the switch housing 30, such that a bottom end of the insulative body 65, such as a taper portion 67 having a converging thickness of this embodiment, resiliently biases towards a contact interface between the first contact 44 and the third contact 49. Hence, deformation of the bi-metallic strip 47 due to overheating drives the third contact 49 to detach from the first contact 44 subjecting the key switch to be under the state of closed circuit. The insulative body 65 interposes between the first contact 44 and the third contact 49 due to resilience of the helical spring 66 so as to ensure that the key switch is maintained under the state of closed circuit prior to resetting the key switch.

Figure 4A:
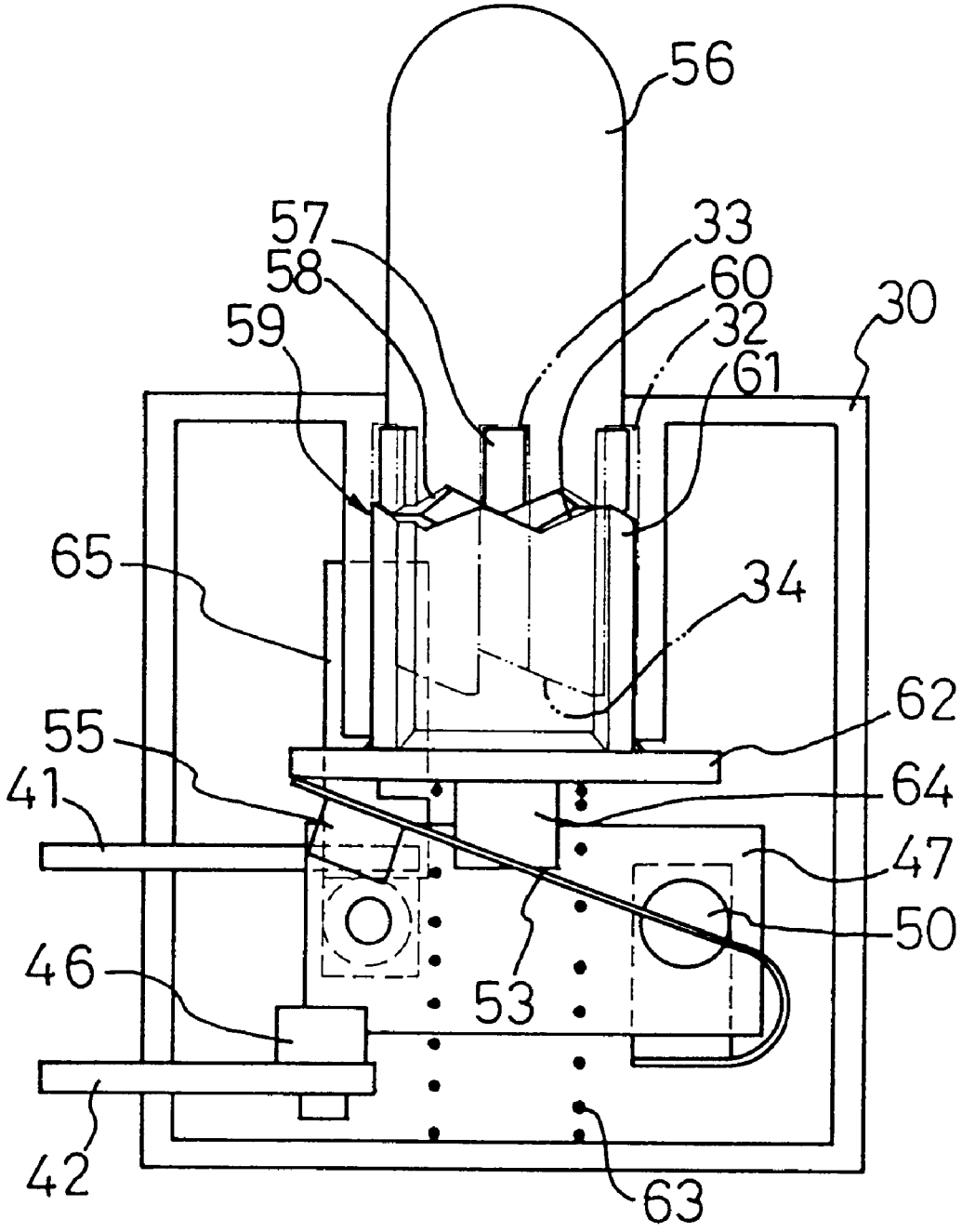
FIGS. 4A through 4D are schematic views of internal constructions of this invention illustrating the operations between the state of closed circuit and the state of open circuit.

FIGS. 4A through 4D are schematic views of internal constructions of this invention illustrating the operations between the state of closed circuit and the state of open circuit. FIG. 4A illustrates the key switch at a first position. As shown in this illustration, the resiliently compressible portion 63 of the connection plate 51, at this time, raises upwards and urges against the bottom 62 of the rotary body 59; the fourth contact 55 is detached from the second contact 46 such that this invention is under the state of closed circuit. Furthermore, the second protrusions 61 on the rotary housing 59 are restrained in the deep guide grooves 32 such that the rotary housing 59 is maintained in a static state.

Figure 4B:
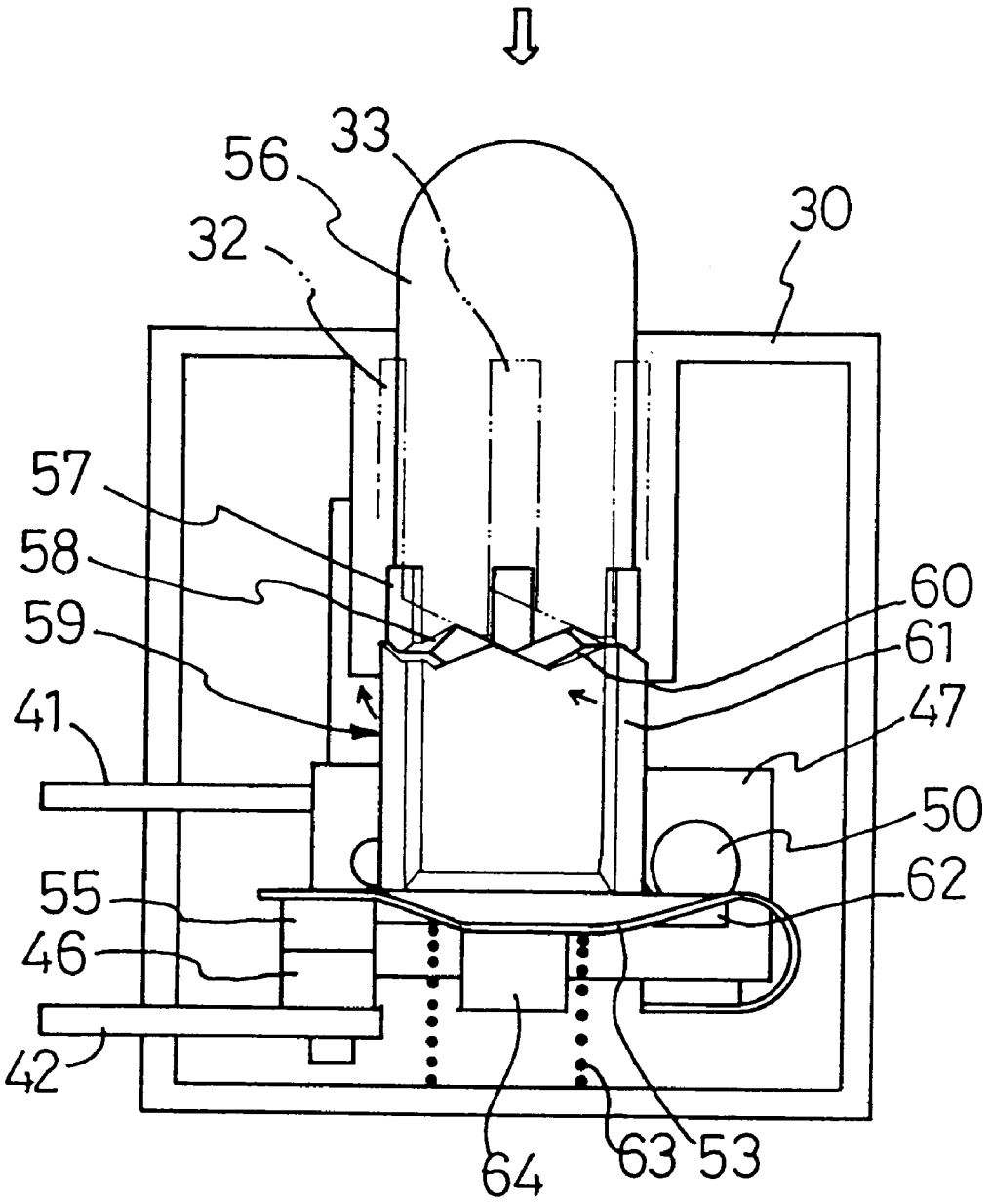
Figure 4C:
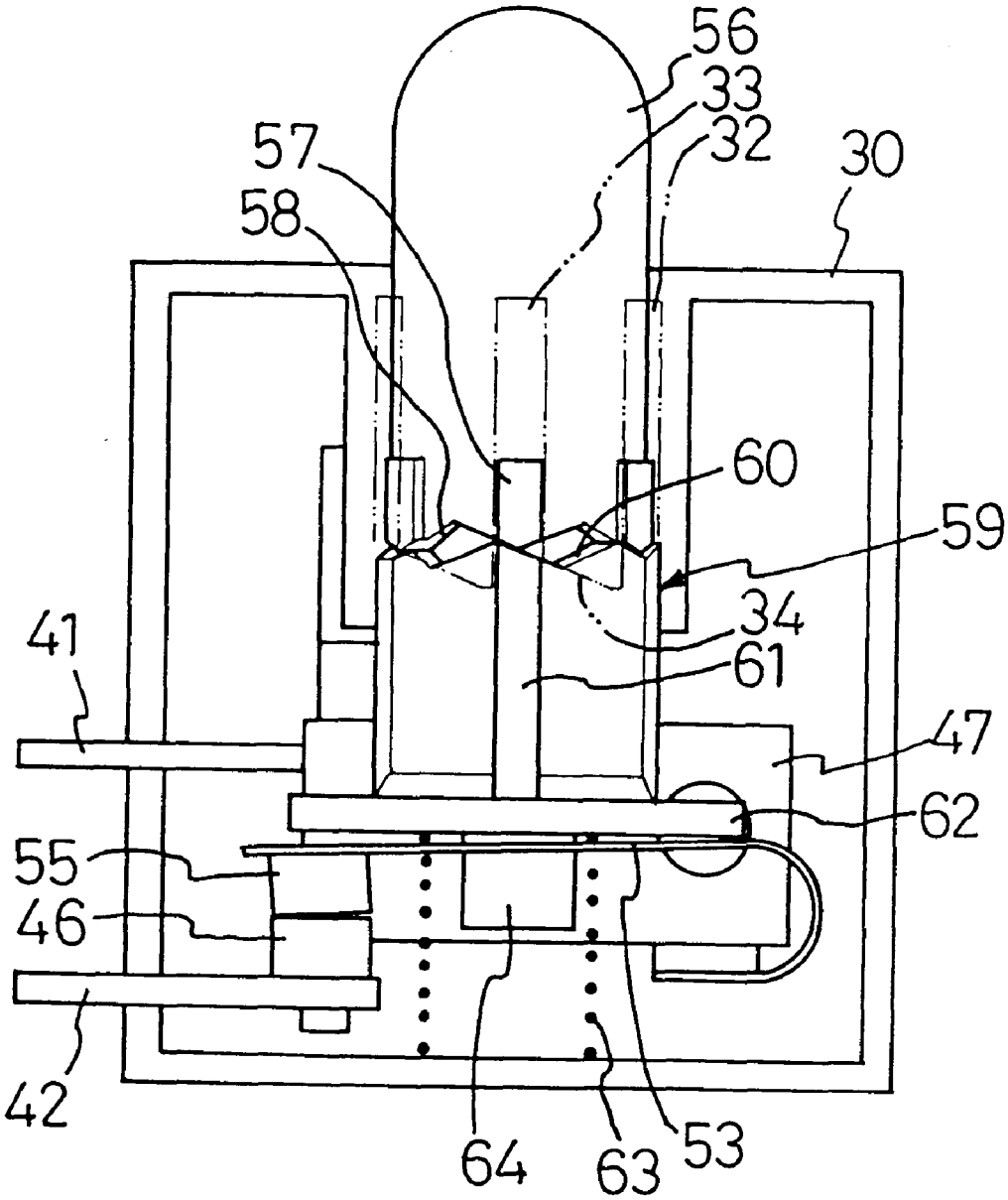

To switch the key switch from the state of closed circuit to that of open circuit, a user may push the key 56 causing the rotary housing 59 to be pushed downwards against the helical spring 63 and the bottom 62 of the rotary housing 59 to drive the resiliently compressible portion 63 of the connection plate 51 moving downwards. As shown in FIG. 4B, when the second protrusions 61 move out of the deep guide grooves 32, because the serrated edge 58 of the key 56 and the serrated edge 60 of the rotary housing 59 initially interlace with each other, and because the helical spring 63 continues to exert force on the bottom 62 of the rotary housing 59, the key 56 is able to rotate for a minute angle in a direction indicated by an arrow of FIG. 4B causing the interlacing key 56 and rotary housing 59 to engage each other. At this time, the resiliently compressible portion 53 is urged by the bottom 62 of the rotary housing 59 and slightly, resiliently flexes and deforms downwards. Releasing the key 56, because of thrust of the helical spring 63, causes the second protrusions 61 of the rotary housing 59 to urge against the slideway 34 configured in a serrated step-shaped configuration of the switch housing 30 and to trace along the slideway 34 causing subsequent rotation and upward movement of the rotary housing 59 until the second protrusions 61 arrive topmost positions of the slideway 34, that is, ends of the shall guide grooves 34, as shown in FIG. 4C, whereby the second protrusions 61 are restrained by the slideway 34 to eliminate further rotation. Since the second protrusions 61 are of thickness that is larger than depth of the shallow guide grooves 33, the second protrusions 61 are only able to urge adjacent the ends of the shallow guide grooves 33 without moving upwards or entering the shall guide grooves 33. At this time, the resiliently compressible portion 53 returns to its initial non-deformed configuration, such as shown FIG. 4C; the fourth contact 55 is in contact with the second contact 46 subjecting the key switch to be under a second position of open circuit. It is worthy to note that, the serrated edge 58 of the key 56 and the serrated edge 60 of the rotary housing 59 again interlace each other at this time.

Figure 4D:
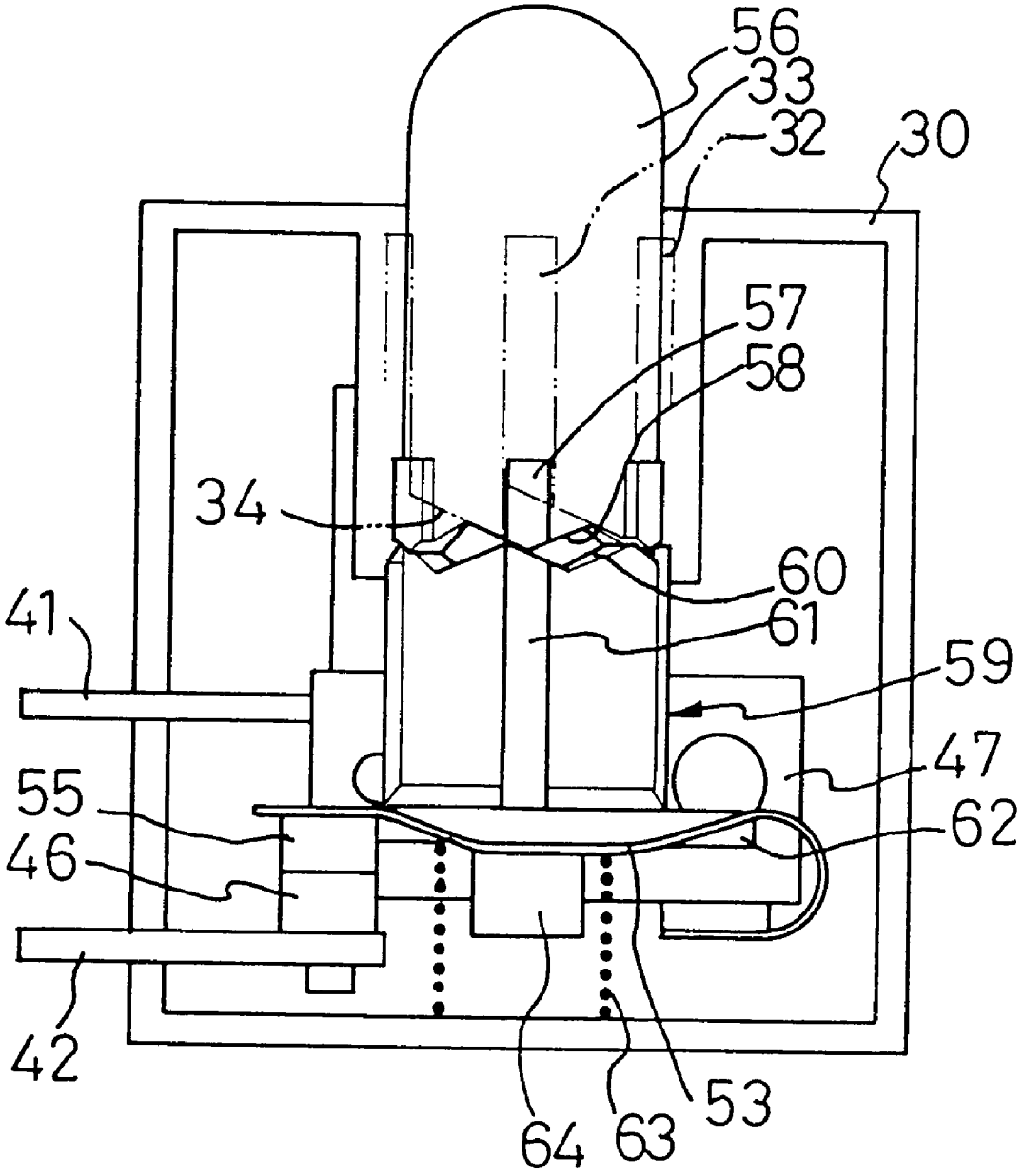

To switch the key switch from the second position of open circuit to the first position of closed circuit, the user may push the key 56 under the state shown in FIG. 4D again. As shown in FIG. 4D, at this time, the resiliently compressible portion 53 of the connection plate 51 again slightly flexes and deforms downwards. When the second protrusions 51 move away from and are no longer restrained by the slideway 34, by the same concepts, the serrated edge 58 of the key 56 and the serrated edge 60 of the rotary housing 59 that originally interlace each other, again engage each other due to force being continuously applied to the bottom 62 of the rotary housing 59, causing the rotary housing 59 to rotate for a minute angle in a direction indicated by an arrow of FIG. 4D. Releasing the key 56, because of thrust of the helical spring 63, causes upward movement of the rotary housing 59 and again causes the second protrusions 61 to urge against the slideway 34 configured in a serrated step-shaped configuration of the switch housing 30 and to trace along the slideway 34 causing subsequent rotation and upward movement of the rotary housing 59 until the second protrusions 61 return to the deep guide grooves 32, that is, the first position of closed circuit as shown in FIG. 4A.

Figure 5A:
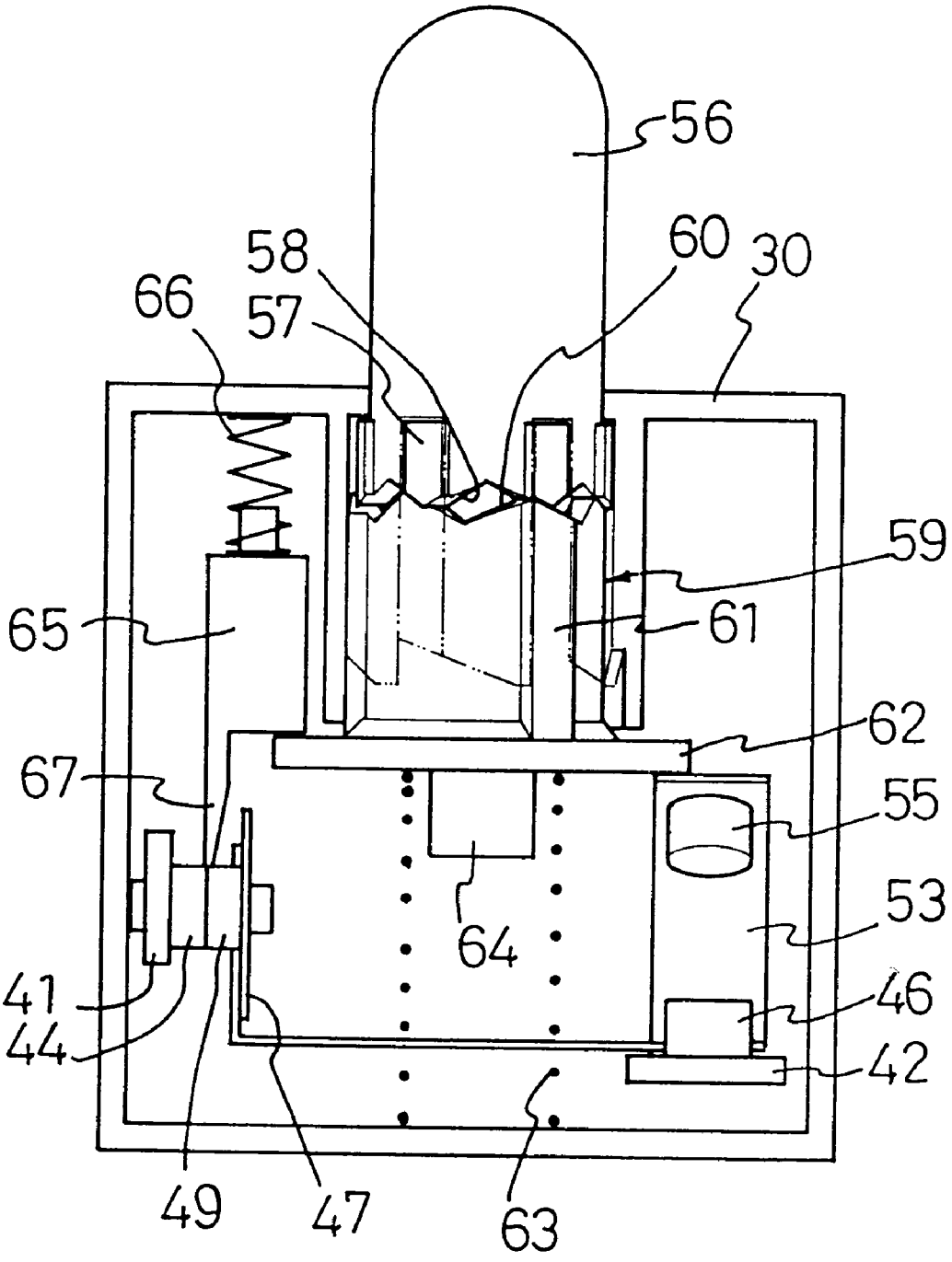
FIGS. 5A through 5C are schematic views of internal constructions of this invention viewed from another perspective illustrating this invention under the state of closed circuit, the state of open circuit, and the state of tripping, respectively.
Figure 5B:
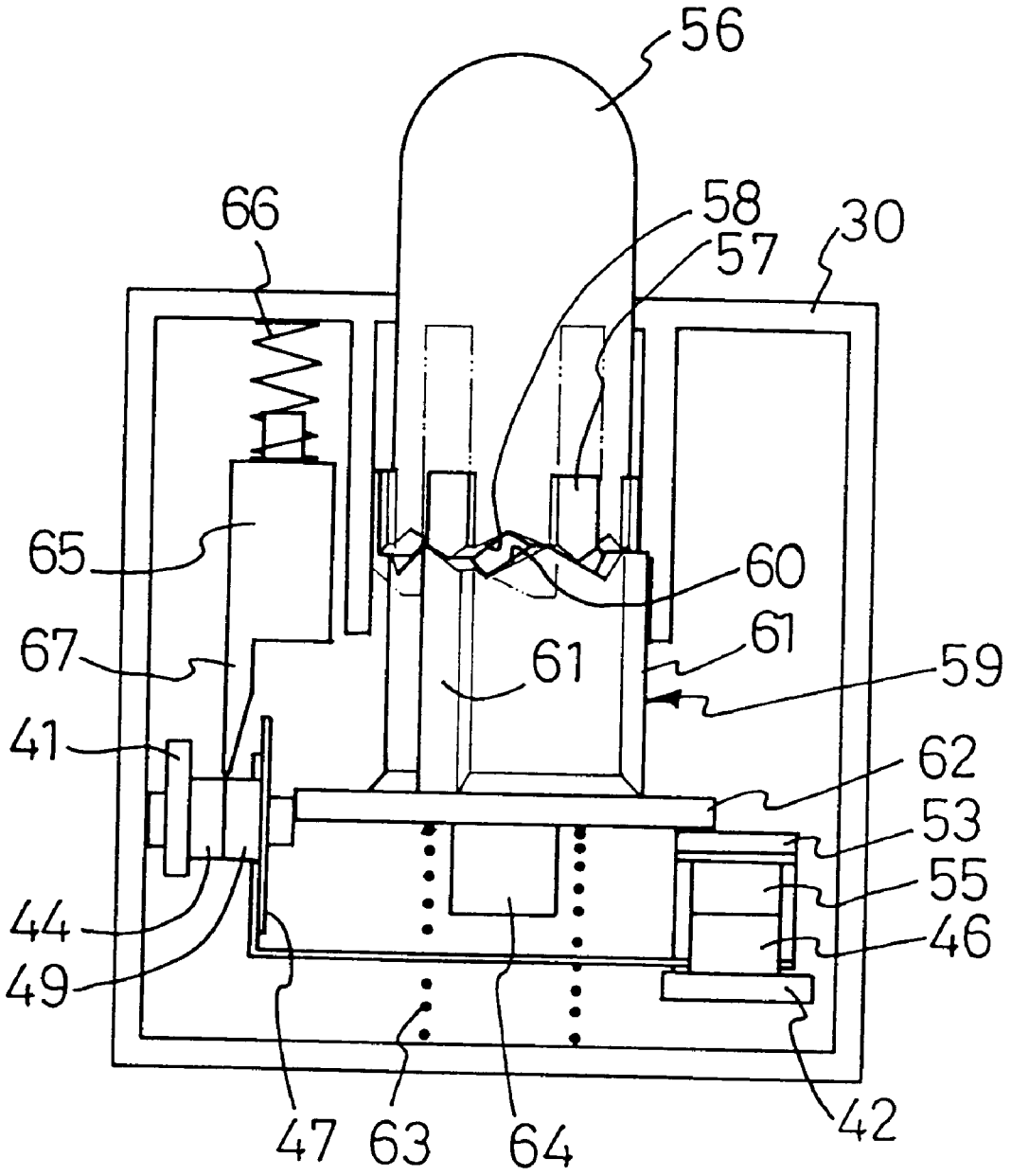
Figure 5C:
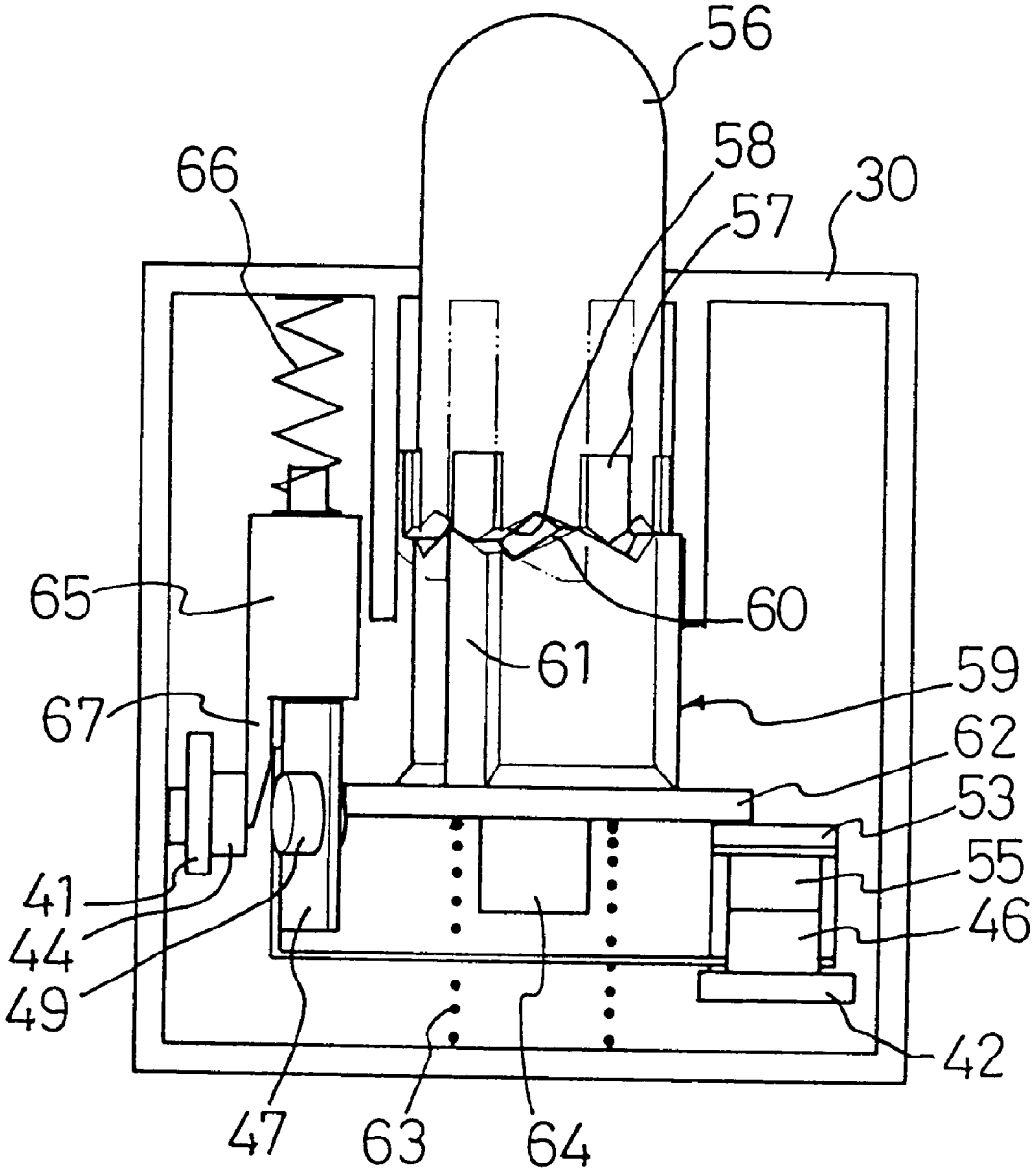

FIGS. 5A through 5C are schematic views of internal constructions of this invention viewed from another perspective, that is, from left side of FIGS. 4A through 4D, wherein FIG. 5A illustrates the key switch of this invention under the first position of closed circuit, at which position the first contact 44 is in contact with the third contact 49, but the fourth contact 55 is detached from the second contact 46. FIG. 5B illustrates the key switch of this invention under the second position of open circuit, at which position, the first contact 44 still remains to be in contact with the third contact 49, and the fourth contact 55 is in contact with the second contact 46 because the resiliently compressible portion 53 of the connection plate 51 is depressed by the bottom 62 of the rotary 59.

One of the primary features of this invention resides in that, when the key switch encounters current overload at the second position of open circuit, lateral deformation of the bi-metallic strip 17, as a result of temperature increase, overcomes resilience of the bi-metallic strip generated by means of stamping and subjects the third contact 49 thereon to move away from the first contact 44, as shown in FIG. 5C. At this time, the taper portion 67 having a converging thickness of the insulative body 65 interposes between the first contact 44 and the third contact 49 due to resilience of the helical spring 66 so as to trip the switch and to ensure that the key switch is maintained under the state of closed circuit. At this time, locations of the key 56 and rotary housing 59 remain the same as where they are at the second position of the open circuit.

After cooling of the bi-metallic strip 47, the user may push the key 56 to reset the switch. At this time, the rotary housing 59 rotates and moves in a manner that is identical to the rotary housing 59 moving from the second position of open circuit to the first position of closed circuit. In the process of returning from the second position to the first position, the bottom 62 lifts the insulative body 65 to a position identical to that prior to tripping because that the bottom 62 of the rotary housing 59 is in the form of a projective skirt, as shown in FIG. 5A. At this time, the third contact 49 is again in contact with the first contact 44 due to resilience of the bi-metallic strip 47.

Therefore, current overload will automatically trip the key switch of this invention so as to form a state that is identical to that of closed circuit. Normal on/off actions can only be carried out until the bi-metallic strip naturally cools down to its normal state. Therefore, this invention can automatically trip the switch to form a closed circuit while encountering current overload so as to ensure electrical safety.

This invention is related to a novel device that breakthroughs conventional art. Aforementioned explanations, however, are directed to the description of preferred embodiments according to this invention. Various changes and implementations can be made by those skilled in the art without departing from the technical concept of this invention. Since this invention is not limited to the specific details described in connection with the preferred embodiments, changes to certain features of the preferred embodiments without altering the overall basic function of the invention are contemplated within the scope of the appended claims.

What is claimed is:

1. An auto tripping multi-state key switch, comprising:

a switch housing being formed with at least one guide groove and one slideway at an inner side thereof;

a first contact strip and a second contact strip both fastened to the switch housing, the first contact strip including a first contact and the second contact strip including a second contact;

a bi-metallic strip having thereon a third contact and being connected to a connection plate having a fourth contact;

a key being provided with at least one first protrusion thereon for engaging the guide groove of the switch housing, the key having an end that is formed with a serrated edge;

a rotary housing being provided with at least one second protrusion thereon for engaging the guide groove and the slideway allowing sliding movement of the rotary housing within the switch housing, the rotary housing having a top end being formed with a serrated edge that cooperates with the serrated edge at the bottom of the key, and the rotary housing having a bottom; and a first resilient member including an end that is fastened to the switch housing and another end that is in contact with the bottom of the rotary housing to bias the rotary housing towards the key in relation of the switch housing;

whereby the bi-metallic strip resiliently urges towards the first contact causing the third contact to be in contact with the first contact while the connection plate continues to resiliently urge on the bottom of the rotary housing; when the key switch is at a first position, the fourth contact on the connection plate is detached from the second contact subjecting the key switch to be under a state of closed circuit; when the key switch is at a second position due to cooperation between the key and the rotary housing, the bottom of the rotary housing exerts a force on the connection plate such that the fourth contact is in contact with the second contact of the second contact strip subjecting the key switch to be under a state of open circuit; and when the key switch encounters current overload, deformation of the bi-metallic strip as a result of temperature increase, subjects the third contact of the bi-metallic strip to move away from the first contact thereby auto-tripping the key switch into the state of closed circuit.

2. The auto tripping multi-state key switch as set forth in claim 1, further comprising an insulative body and a second resilient member fastened within the switch housing, the insulative body having an end that is connected to the second resilient member, such that another end of the insulative body resiliently biases towards a contact interface between the first contact and the third contact, whereby when the third contact is detached from the third contact subjecting the key switch under the state of closed circuit, the insulative body interposes between the first contact and the third contact due to resilience of the second resilient member.

3. The auto tripping multi-state key switch as set forth in claim 1, wherein the bottom of the rotary housing is formed with a projective skirt such that when the key switch trips and returns from the second position to the first position, the skirt lifts the insulative body to a position identical to that prior to tripping.

4. The auto tripping multi-state key switch as set forth in claim 1, wherein the bi-metallic strip is made by joining two or more than two metallic sheets having different coefficients of thermal expansion such that the bi-metallic strip deforms upon temperature increment and returns to normal state when the bi-metallic strip cools down.

5. The auto tripping multi-state key switch as set forth in claim 1, wherein the bi-metallic strip is formed by stamping subjecting the bi-metallic strip to resiliently urge towards the first contact.

6. The auto tripping multi-state key switch as set forth in claim 1, wherein the first resilient member is a helical spring, and the rotary housing is provided with a post for engaging and guiding the helical spring.

7. The auto tripping multi-state key switch as set forth in claim 1, wherein the switch housing is alternatively formed with three relatively deep, linear guide grooves and three relatively shallow, linear guide grooves, the guide grooves each having an open end.

8. The auto tripping multi-state key switch as set forth in claim 7, wherein the slideway is located between each two open ends of deep, linear guide grooves and is configured in a serrated step-shaped configuration.

9. The auto tripping multi-state key switch as set forth in claim 1, wherein the first and the second contact strips each have an end that exposes out of the switch housing so as to be connected to electrical leads.

* * * * *